United States Patent [19]

Trilli

[11] Patent Number: 4,522,400

[45] Date of Patent: Jun. 11, 1985

[54] CONVEYOR SYSTEM AND METHOD FOR RANDOMLY TRANSPORTING CARD RACKS TO GAMBLING TABLES

[76] Inventor: Pat Trilli, 1529 Dean St., New York, N.Y. 11213

[21] Appl. No.: 595,690

[22] Filed: Apr. 2, 1984

[51] Int. Cl.[3] ..... A63F 1/10

[52] U.S. Cl. ..... 273/148 A

[58] Field of Search ..... 273/144 R, 148 R, 148 A, 273/149 R, 149 P, 150, 151, 309

[56] References Cited

U.S. PATENT DOCUMENTS

| | | | |
|---|---|---|---|
| 653,665 | 7/1900 | De Leon | 273/151 |
| 1,909,340 | 2/1929 | Fuller | 273/151 |

*Primary Examiner*—Richard C. Pinkham
*Assistant Examiner*—Vincent A. Mosconi
*Attorney, Agent, or Firm*—Arthur L. Plevy

[57] ABSTRACT

A conveyer system is employed in a casino and transports a series of housings between a plurality of blackjack tables. The conveyer system is controlled such that the housings are randomly stopped at each table to enable a dealer to replace a depleted rack of cards with a new rack of cards contained in each of the housings. The conveyer system as controlled operates at any speed desired and randomly causes the housings coupled to the conveyer to be stopped at the tables so that a dealer, in accessing a new rack of cards contained in the housing, will replace the rack with the used rack. The system as depicted reduces cheating as by the use of marked cards and further reduces the time between deals as eliminating shuffling and repacking of the racks by the dealer.

15 Claims, 7 Drawing Figures

CONVEYOR SYSTEM AND METHOD FOR RANDOMLY TRANSPORTING CARD RACKS TO GAMBLING TABLES

BACKGROUND OF THE INVENTION

This invention relates to apparatus and a method for distributing racks of cards to blackjack tables as those located in a gambling casino.

As one can ascertain, the gambling industry has expanded greatly in the United States. Presently, the large gambling centers of the United States such as Las Vegas and Atlantic City accommodate many casinos. A extremely popular game which is played in all the casinos is blackjack. As one can ascertain, the blackjack tables are normally located in common areas and there may be, for example, a plurality of tables in a common location, each one spaced apart from the other and normally arranged in a symmetrical pattern.

The game of blackjack is well known, and as presently played in the canino, a dealer will distribute cards from a rack or box which rack or box contains a plurality of decks.After a predetermined number of cards have been dealt based on a reference card which is randomly inserted into the stack of cards, the dealer has to reshuffle the cards, cut the cards and then again insert the cards back into rack. This takes time and, therefore, creates a delay. Furthermore, the same cards are employed at the same table during the course of the day. As one will ascertain, there have been considerable problems involving the game of blackjack where dealers have cooperated with coustomers and have used marked cards to enable certain customers to win large amounts of money. This is extremely difficult to avoid due to the fact that even though the cards are randomly distributed within the rack or card housing, the cards can be marked and since they remain at the same table, a player who knows the markings can take unfair advantage of the house.

Furthermore, as indicated above, when a dealer completes the run of cards in a rack, he must reshuffle the decks which is a time consuming task.

The present invention anticipates a solution to such problems and serves to eliminate the time required for shuffling cards and further serves to provide a method and apparatus whereby racks of cards are transported by a conveyer system which conveyer system is radomly controlled. In the system the conveyer carries a plurality of housings each of which has a door and each of which can carry a rack of cards. The motion of the conveyer is randomly controlled such that different housings will stop at each table during the conveying process to enable a dealer to remove an entire rack of cards from the table and to insert the rack into an appropriate conveyer housing which also contains a new rack of cards which will now be used by the dealer after completing his run.

Thus when a dealer completes the run of cards, all he has to do is place the completed rack of cards into the overhead housing as conveyed by the conveyer system and replace his unit with a new rack of cards. The conveyer system causes the housings to rotate from table to table at whatever speed is desired as will be explained.

Thus the above noted system substantially avoids the problem associated with marked cards and further eliminates and reduces the time required for the dealer to reshuffle and form a new rack as is presently done.

DETAILED DESCRIPTION OF THE FIGURES

Figure 1:
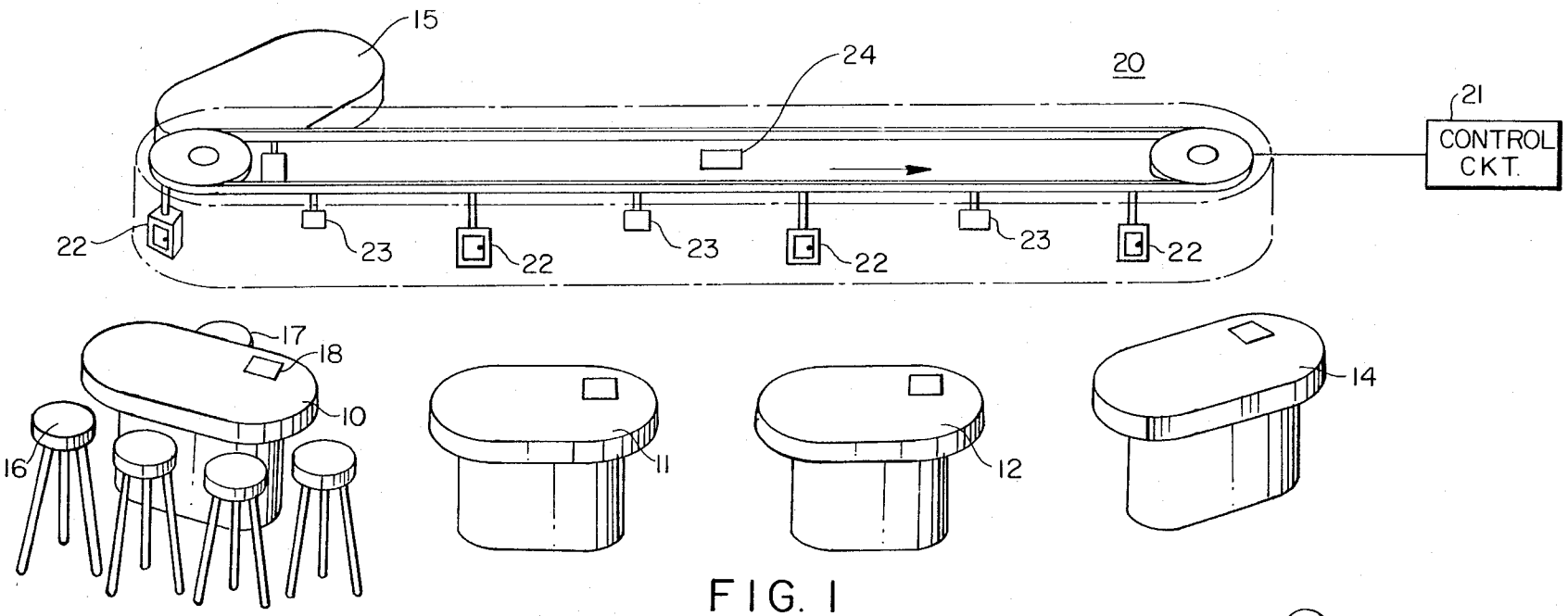
FIG. 1 is a pictorial view of a conveyer system employed in a casino for distributing cards to a plurality of blackjack tables.

Referring to FIG. 1, there is shown a basic layout of a typical blackjack table arrangement.

In a typical gambling casino a series of blackjack tables such as 10 to 15 are arranged about a given area as shown. Each table such as table 10 has a number of seats for patrons of the casino. The dealer 17 stands behind the table and deals cards from a housing or rack 18. The housing 18 may contain 4 or more decks of cards. Such housings are well known and are widely employed in most casinos. As above indicated, when the dealer completes the run of cards, he removes the decks from the rack 18 and shuffles the cards, has a player insert a reference card and then places the decks back into the rack 18.

As seen in the Figure, positioned above the tables is a conveyer system 20. The conveyer system is a conventional conveying system as of the type presently manufactured by many companies and for example as shown in many prior art patents.

Conveyer system for all types of use are widley known, and for example see U.S. Pat. No. 3,495,545 entitled CONVEYER issued on Feb. 17, 1970 to Z. Radovic. Also see U.S. Pat. No. 2,975,729 issued on Mar. 21, 1961 to E. E. Stechbart el al. Other patents as U.S. Pat. No. 4,029,199, U.S. Pat. No. 3,854,573 and U.S. Pat. No. 3,866,779 all depict various conveying systems which systems can traverse circuitous paths and hence be directed along any given line. It is understood that any transporting system would be applicable such as an overhead monorail system or an endless belt conveying system. As the function of the conveyer 20 is to move racks of cards about a path which overlies the various tables in order to deliver to each table a different rack of cards according to this invention.

Most of these conveyer systems can be driven by a motor to cause the system to traverse the path. Hence the coveyer system 20 as shown in FIG. 1 is one of many types of existing conveyer systems and is driven, as will be explained, by a unique control circuit 21.

Figure 2:
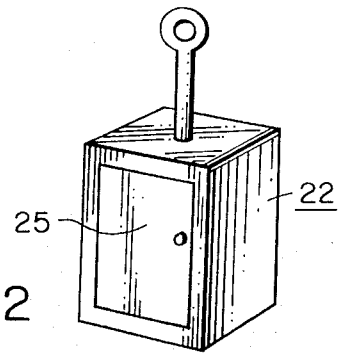
FIG. 2 is a plan view of a typical card accommodating housing.

Suspended from the conveyer are a series of housings 22. Each housing as 22 and as shown in FIG. 2 is a box-like structure having a front door 25 and an internal hollow of a large enough volume to carry a rack of cards. The housings as 22 are suspended from a suitable mechanism on the conveyer belt and, therefore, rotate or move as the conveyer moves under the control of the control circuit 21.

Also shown in FIG. 1 are a series of reflectors 23 which as will explained are associated with a position sensor 24. The position sensor 24 operates in conjunction with the reflecting surface 23 to determine the location of the housing 22 with respect to each table as 10 to 15. In this manner the system assures that a housing 22 will stop in a proper location so that the dealer will have ample time to access the housing and to insert the depleted rack of cards into the housing while removing another rack for the next deal.

As will explained, the conveyer system works in a random manner, and hence the dealer can never be assured which rack of cards he will obtain upon each deal. Thus the chances of the dealer receiving the same rack of cards as previously used by him is substantially reduced, and hence this aspect prevents the use of marked cards from affecting playing. Furthermore, the conveying system as controlled also eliminates the need for the dealers to reshuffle and stack a new rack after a completed run of cards. This, therefore, eliminates a great deal of time which is used by the dealer to to this. Hence a casino will experience quicker plays at the tables while being assured that the above noted problems are also solved.

Figure 3:
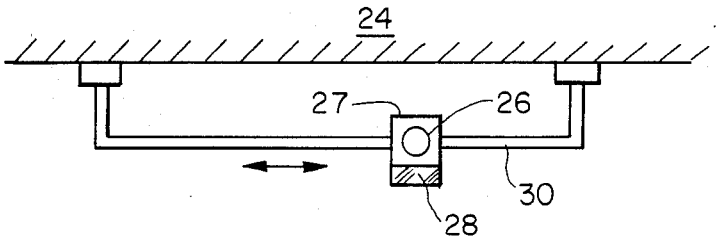
FIG. 3 is a plan view of a position sensor device.

Referring to FIG. 3, there is shown one example of the position detector device 24.

Essentially, the position detector device 24 includes a light source 26 which may be an infrared source contained in a housing 27. Located beneath the infrared light source is a photodetector 28. The detector 28 is responsive to infrared light and will provide a low impedance output when a beam of infrared light impinges thereon. The housing 27 is adjustable in the horizontal plane by means of moving the housing in the direction depicted by the arrows on the rail 30. In this manner the housing may be moved so that the reflector 23 as shown in FIG. 1 positively determines the location of each housing 22 with respect to each table as 10 to 15.

Figure 4:
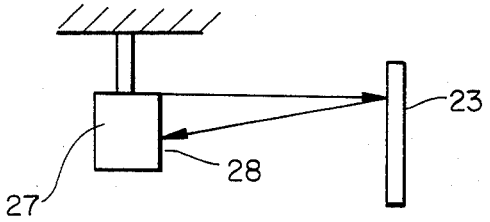
FIG. 4 is a simple schematic view of the operation of one type of position sensor.

As shown in FIG. 4, a beam of light which emanates from source 26 impinges on the reflecting surface of the member 23 and is reflected back upon the photodetector 28. This only occurs when a reflector 23 is aligned with the photodetector as 28 as contained in housing 27. The use of light beams as well as photodetectors are also well known in the art and many examples of such devices exist.

Figure 5:
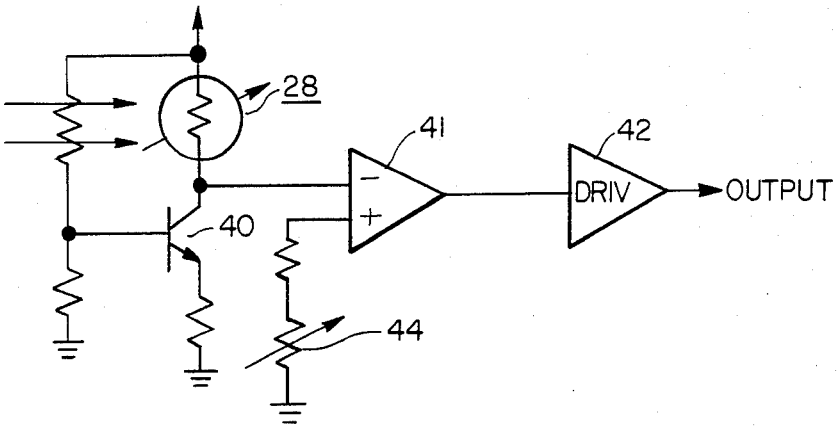
FIG. 5 is a schematic circuit diagram showing the components employed in a position sensor.

Referring to FIG. 5, there is shown a simple schematic diagram depicting the use of the photodetector 28 in order to produce an output indicative of the position of each of the housings 22 with respect to the tables 10 to 15. In FIG. 5 a transistor amplifier 40 contains a photocell as 28 as a load. When light impinges upon the photocell, the impedance is reduced thus raising the voltage at the collector of transistor 40. This is amplified by means of an operational amplifier 41 having an output coupled to a driver circuit 42. The operational amplifier also contains an adjustable control 44 to enable one to adjust the threshold of the device to accommodate for different lighting conditions existing in various casinos.

Figure 6:
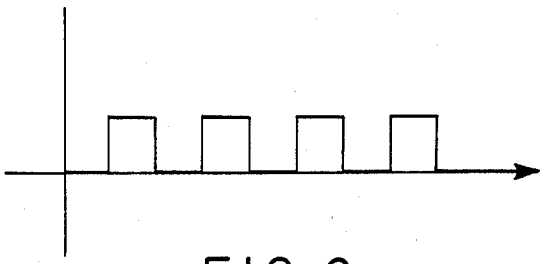
FIG. 6 is a waveform depicting the output of the position sensor.

As shown in FIG. 6, as the conveyer rotates, each reflector 23, when passing the position sensor or detector 24, will produce a pulse. The width of the pulse in a function of the width and speed of the reflecting surface while the frequency of the pulses is a function of the speed of the conveyer system. As will be explained, the speed of the conveyer system is adjustable and hence can be selected according to the particular needs of the casino as a function of the number of players and the number of tables being used.

Figure 7:
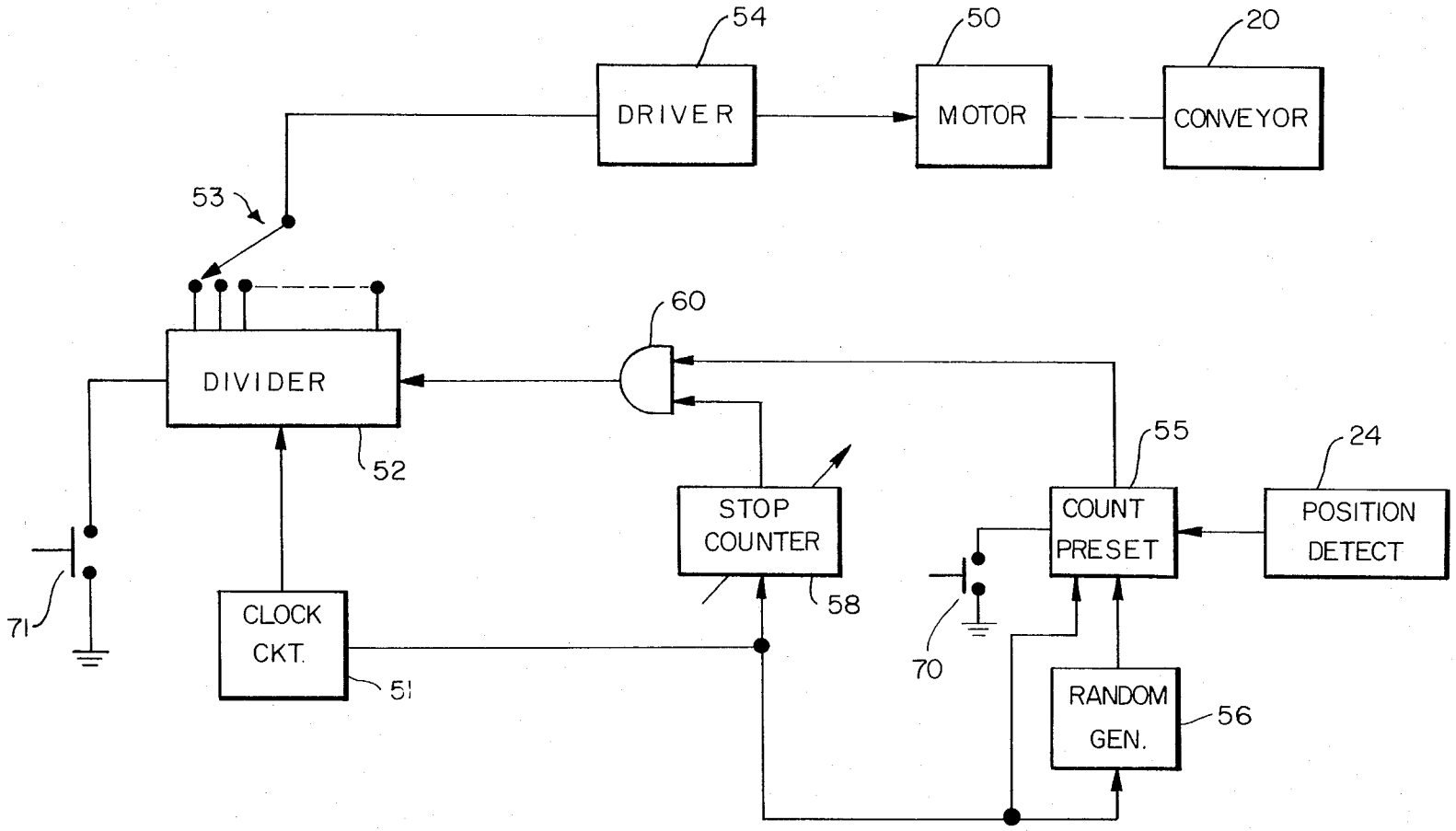
FIG. 7 is a detailed block diagram showing the control circuitry for a conveyer system according to this invention.

Referring to FIG. 7, there is shown a schematic diagram depicting the control circuit as 21 of FIG. 1 for operating the conveyer system 20. The conveyer system 20 is controlled by a motor 50 which may be an AC motor which speed will vary as a function of frequency. Controls for motors as both AC and DC are well known. In any event, in the system to be described the motor is controlled such that the rack carrying housing 22 will stop at the tables in a random manner. In this manner a dealer will have access to a different rack of cards during each deal. The system operates as follows.

A clock circuit 51 has one output coupled to a divider 52. The divider 52 is a conventional divider which may contain a series of bi-stable multivibrators which divide the clock frequency into various different frequencies depending upon the number of stages. The various frequency outputs of divider 52 are selected by means of a switch 53. In this manner the setting of switch 53 determines the speed at which the motor is driven by a power amplifier 54. Thus the casino operator or supervisor can set the speed of the conveyer system by means of switch 53 and hence cause the conveyer to operate faster or slower.

In any event, as explained above, the conveyer has to stop at certain intervals in order to allow dealers to access the housings 22 so that they can access a new rack of cards and replace the present rack within the housing. In order to accomplish this, the position detector 24 has an input coupled to a setable counter 55. Essentially, counter 55 is a well known component. In such counters pulses are directed to the input and the counter will stop when a certain number of pulses as present are received. For example, the counter may be set to count 8 pulses. In this manner when eight pulses are received from the position detector 24, the counter 55 will produce an output. The presetting of the counter 55 is controlled by a random generator 56 which generator is operated by the clock circuit 51. Hence the random generator 56 provides a random count which count serves to preset the counter, for example to one or eight or more pulses. Also coupled to the clock circuit is an additional counter 58 designated as stop counter. The counter 58 produces an interval which is of a time completely sufficient to enable a dealer to remove a rack of cards from housing 20. The stop counter 58 may also be a frequency divider which is capable of being adjusted, as is well known, to produce a series of intervals to enable the conveyer to stop for the time determined by the stop counter.

The output of the stop counter is coupled to an AND gate 60 which also receives an output from the preset counter 55. In regard to the circuit shown in FIG. 7, the conveyer depicted in FIG. 1 is controlled as follows.

As indicated, the speed of the conveyer is set by means of switch 53 which selects a frequency from divider 52 determining the speed of the motor 50. As the conveyer rotates, the housings 22 are transported between the tables at the speed selected. The reflectors 23 produce the pulse train shown in FIG. 6 during the rotation. This pulse train is applied via the position detector 24 to the preset counter 55 which has been preset by the random generators 56.

For example, assume that the preset counter has been set to count 3. At the end of three pulses, the counter 55 produces an output. This output is directed to one input of gate 60. The other input of gate 60 receives a long extended pulse from the stop counter 58. The presence of both pulses inhibits the divider 52 which in turn stops the motor 50. It is noted that the motor can only be stopped during the presence of the detector pulse and hence the housings 22 will positioned above each table based on the fact that the position sensor 24 is located with respect to the reflectors 23 which in turn specify the position of each housing.

Thus in the example given above, each table will have positioned above the table a housing 22 which is the third housing along the conveyer after the inception of the start interval. Thus the housings as positioned will remain above the table for the length of time determined by the counter 58. As soon as the counter 58 completes the timing interval, a small pulse is provided which pulse disables gate 60 and allows the conveyer to continue rotation by enabling the divider 52. The random generator now provides another preset count for counter 55. Based on the new count, the counter 55 may be set to count eight pulses. At the end of the eight pulse count, a new housing 22 will be positioned above each table. Thus as seen, the dealer at each table has no control over which housing he will use at the end of a run. The dealer merely waits for the conveyer to stop, accesses a housing to obtain a new rack of cards and replaces his rack within the housing. The process continues and as indicated, randomly distributes cards between the tables to thus prevent cheating and to reduce or control the length of time between each deal.

As shown in FIG. 7 are switches as 70 and 71. As one can ascertain, switch 70 will function to inhibit the preset counter 55. If this is accommodated, then the conveyer 20 will be driven strictly by the stop counter 58. Hence the housings 22 will stop for each output of the stop counter. This essentially will provide a continuous rotation and stopping of the housings. The switch 71 will operate to inhibit the divider 52 and, therefore, stop the entire conveyer system if necessitated by the casino.

It is, of course, understood that the above description anticipates many modifications which will be discerned by those skilled in the art and which are deemed to be encompassed within the scope and breadth of the claims appended hereto.

I claim:

1. Apparatus for distributing racks of cards to a plurality of card tables as located in a casino and arranged about a given path about the casino floor, comprising a drivable belt means arranged to traverse said given path, said belt means having positioned thereon a plurality of housings each capable of converying a rack of cards for each of said tables and spaced apart on said belt means according to the spacing between said tables, whereby when one housing is in the vicinity of one table each of the other housings is in the vicinity of an associated table, control means coupled to said belt means for driving the same about said path and means responsive to the position of said housings for randomly stopping said belt means to cause a random distribution of said housings with respect to said tables, whereby each of said tables will be associated with a different housing according to the operation of said means for randomly stopping said belt means, to thereby enable each table to receive different racks of cards during play.

2. The apparatus according to claim 1, further including a motor coupled to said belt means for driving the same with said motor controlled by said control means.

3. The apparatus according to claim 2 whereby said control means further includes means for selectively varying the speed of said motor and therefore the speed of said belt means as traversing said path.

4. The apparatus according to claim 3 wherein said means for randomly stopping said belt means includes position sensor means associated with said belt means and operative to provide a control signal indicative of the position of said housings with respect to said tables to assure that each table has a housing in the vicinity thereof.

5. The apparatus according to claim 1 wherein said card tables are blackjack tables.

6. The apparatus according to claim 1 further including means located on said belt means and positioned between respective areas of said housings to provide an indication of the location of said housing with respect to said tables.

7. Apparatus for distributing racks of cards to a plurality of card tables as located in a casino and arragned about a given path on the casino floor, comprising:

a conveyer means directed about said tables and along said given path, said conveyer means having positioned thereon a plurality of card carrying means each spaced apart on said conveyer means according to the spacing of said tables, driving means coupled to said conveyer means for moving said conveyer means along said path, position detecting means responsive to said movement to provide a control signal indicative of the position of said card carrying means with respect to said tables, control means responsive to said control signal and operative to provide a random output signal for randomly inhibiting said driving means to stop said conveyer whereby a different card carrying means is stopped at a different table according to said control signal.

8. The apparatus according to claim 7 wherein said driving means further includes means for selectively varying the speed at which said conveyer is moving.

9. The apparatus according to claim 8 wherein said position detecting means includes a source of light located at a fixed position with respect to said conveyer means, with said conveyer further carrying reflective members to reflect said beam of light back to said position detecting means and means responsive to said reflected beam to provide a control signal indicative of the position of said card carrying means.

10. The apparatus according to claim 9 wherein said card carrying means each includes a housing coupled to said belt and having an internal hollow for carrying a rack of cards.

11. The apparatus according to claim 7 wherein said control means includes a preset counter capable of providing an output when receiving a given number of input signals, said counter coupled to a random generator for randomly setting the same, with the input of said counter coupled to said position detecting means and responsive to a given number of said control signals to provide an output according to the random setting of said counter by said generator whereby said driving means will be inhibited according to the random setting of said preset counter.

12. A method of distributing card racks between a plurality of card tables as located in a casino and arranged about a given path about the casino floor comprising the steps of:

transporting said plurality of card racks from table to table in a closed and continuous path, randomly stopping the transport of said racks at said tables to cause a different rack to stop at a different table in a random manner, replacing said rack of cards as stopped at said table with the rack of cards presently used at said table and repeating the steps of transporting, stopping and replacing.

13. The method according to claim 12 wherein said card tables are blackjack tables.

14. The method according to claim 12 wherein the steps of transporting said plurality of card rack from table to table includes conveying said racks by means of an endless belt conveyer, with said conveyer having positioned thereon a plurality of housings each capable of accommodating a rack of cards.

15. The method according to claim 12 further comprising the steps of:

detecting when a rack of cards is at a table for providing an indication that each table is associated with a rack of cards.

* * * * *